United States Patent [19]

Szymansky et al.

[11] Patent Number: 4,751,781

[45] Date of Patent: Jun. 21, 1988

[54] ELECTRIC DRY SHAVER HAVING AN IMPROVED HEAD GUARD

[75] Inventors: Edward Szymansky, Fairfield; Robert A. Mockovak, Newtown; Richard M. McCarthy, Bridgeport, all of Conn.

[73] Assignee: Remington Products, Inc., Bridgeport, Conn.

[21] Appl. No.: 908,324

[22] Filed: Sep. 17, 1986

[51] Int. Cl.[4] ..... B26B 21/40

[52] U.S. Cl. ..... 30/90; 30/32; 30/43.92

[58] Field of Search ..... 30/90, 32, 34 R, 43.9, 30/43.92, DIG. 2

[56] References Cited

U.S. PATENT DOCUMENTS 3,167,804 2/1965 Naumann ..... 30/90

*Primary Examiner*—Douglas D. Watts

[57] ABSTRACT

A protective, demountable head guard is provided for an electric dry shaver which includes a segment adapted for inhibiting movement of a shaver actuating switch and thus avoiding potential inadvertant operation of the shave. The head guard is also sized so as to be captivated by the shaver and upon the application of a manual actuating force to an electric switch slide on the shaver, the head guard is automatically released from the captivated position.

20 Claims, 2 Drawing Sheets

ELECTRIC DRY SHAVER HAVING AN IMPROVED HEAD GUARD

BACKGROUND OF THE INVENTION

1. Field of the Invention

This invention relates to electric dry shavers and more particularly to an improved head guard arrangement for an electric dry shaver.

2. Description of the Prior Art

Hand-held electric dry shavers include a cutter head having a hair cutting member which is applied to a user's face during a shaving operation. The cutter member is carefully fabricated to have sharp cutting edges. It is important for continued satisfactory operation of the shaver that the cutter member retain its sharp cutting edges. One precaution to this end provides for protecting the cutter member from contact damage and abrasion with other objects when the shaver is not in use. Such contact damage can occur, for example, during travel when a user may be expected to store the electric dry shaver with other toiletry articles in a suitcase or other container. As is well known, suitcases and their contents can be expected to encounter considerable jarring during handling and transit. It is thus customary to provide a demountable head guard to protect the cutting edges when the shaver is not in use.

Electric dry shavers include a manually actuated on/off switch which when actuated causes the energization of an electric motor. The energized motor is coupled to and causes operation of the cutting members. One form of electric dry shaver is cordless in that in includes batteries which store a charge sufficient to operate the motor for a number of shaving uses. It has been found that during transit and other types of movement, a jarring of the shaver itself has at times resulted in contact with and movement of the on/off switch to the extent that the electric power from the batteries is applied to the motor and the cutter head is actuated. This unknown and general continuous actuation of the shaver usually results in a total discharge of the batteries over a period of time. Consequently, the shaver cannot be used until the batteries are recharged. Recharging can take as long as twenty-four hours and the shaver is effectively unavailable for this period of time. It would be beneficial if the shaver could be readily and economically inhibited from such advertant operation.

SUMMARY OF THE INVENTION

Accordingly, it is an object of this invention is to provide an improved head guard arrangement for an electric dry shaver which cooperates with a shaver switch for inhibiting actuation of the shaver until the head guard is removed.

Another object of the invention is to provide an improved head guard arrangement for an electric dry shaver which inhibits inadvertant operation of a battery-operated shaver.

Another object of this invention to provide an improved head guard arrangement for an electric dry shaver.

Another object of the invention is to provide an improved head guard for an electric dry shaver having an improved seating arrangement for maintaining the head guard in position on the electric dry shaver.

A further object of the invention is to provide an electric dry shaver having an improved head guard wherein the head guard cooperates with an electric shaver actuating switch to automatically release the head guard upon manual actuation of the switch.

In accordance with features of the invention, an improved electric dry shaver comprises a hand-held housing, a shaver cutter head mounted at one end of the housing and a shaver actuating switch positioned on the shaver. A protective, demountable head guard is provided for positioning on the shaver about the cutter head for protecting the shaver head from contact damage when the shave in inoperative. The head guard includes a segment thereof which when seated on the shaver is juxtaposed with the switch and restricts movement of the shaver switch to thereby inhibit inadvertant actuation of the shaver. Removal of the head guard enables manual actuation of the switch.

In accordance with other features of the invention, the head guard includes means for captivating the head guard to the shaver and for releasing the head guard upon application of a manual actuating force to the shaver switch.

BRIEF DESCRIPTION OF THE DRAWINGS

These and other features and objects of the invention will become apparent with reference to the following specification and to the drawings wherein.

DETAILED DESCRIPTION

Figure 1:
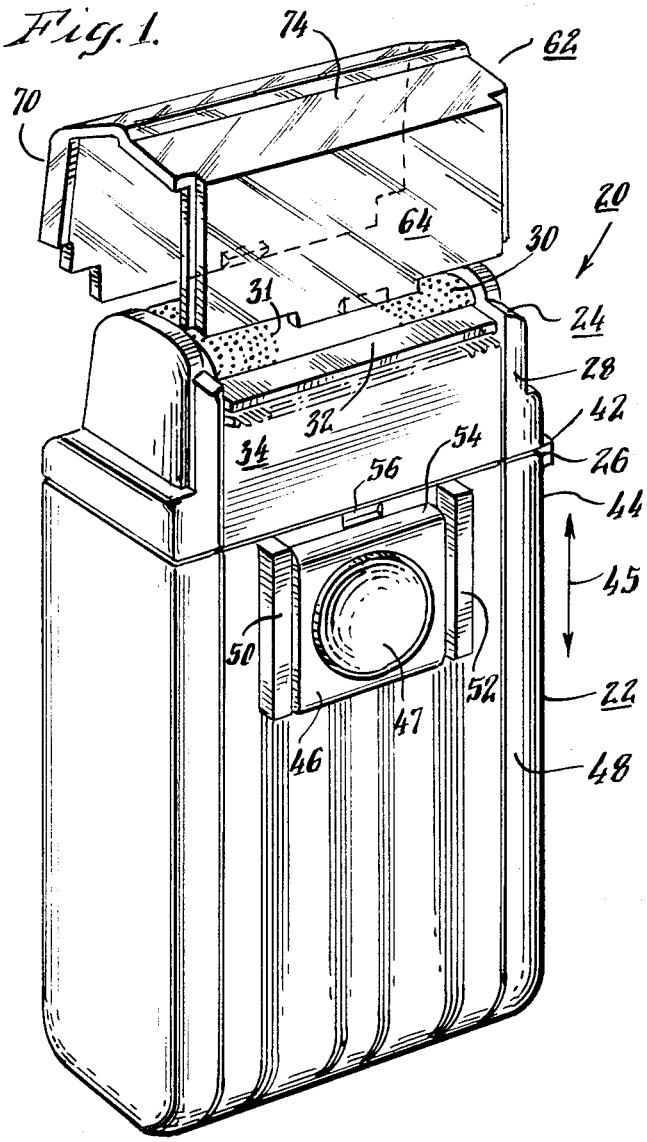
FIG. 1 is a perspective view illustrating a hand-held electric dry shaver and a demounted head guard constructed in accordance with one embodiment of the invention.

Referring now to the drawings, a hand-held electric dry shaver 20 is shown which includes a housing 22 and a shaver head 24 positioned at one end 26 of the housing. The shaver head 24 may take various embodiments. The embodiment shown comprises a demountable hair pocket 28 having an outer cutter member 30 comprising an apertured foil with a plurality of apertures 31 formed therein. The outer cutter member 30 cooperates with an assembly of inner cutter blades, not illustrated, which operate to shear body hairs extending through the apertures 31. A trimmer assembly 32 for trimming longer hairs is also provided and is mounted to the hair pocket 28 on a side 34 of the shaver. A shaver head of the demountable hair pocket type having a foil-type cutter assembly and trimmer assembly, as indicated, is known in the art and are disclosed, for example in U.S. Pat. No. 4,089,109, which is assigned to the assignee of this invention and the disclosure of which is incorporated herein by reference.

A skin stretcher 36 is also illustrated and is mounted to the hair pocket on a second side 38 of the shaver. The skin stretcher which is shown in a retracted position includes a finger slide segment 40. When a manual finger force in an upper direction 41 is applied to the slide segment 40, the skin stretcher is advanced to an operative position at which location it cooperates with the cutter head to engage a user's facial skin and enhance the cutting operation. The skin stretcher is disclosed in greater detail in corresponding U.S. patent application Ser. No. 729,366, filed May 1, 1985 which is assigned to the assignee of this invention and the disclosure of which is incorporated herein by reference.

Hair pocket 28 is demounted from the shaver housing 22 by depressing a push button 42 which is mounted on a side 44 of the housing 22. Depressing the push button 42 actuates a hair pocket catch mechanism, not illustrated, thereby releasing the catch and permitting removal of the hair pocket.

Figure 2:
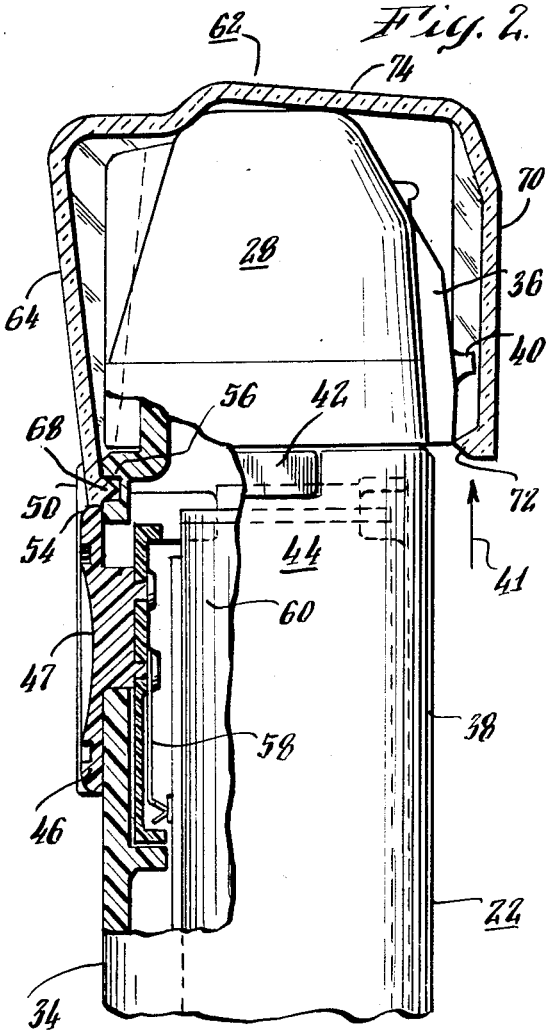
FIG. 2 is an enlarged, fragmentary, side elevation view, partly broken-away, and partly in section of the electric dry shaver of FIG. 1 illustrating the head guard shown mounted to the shaver.
Figure 3:
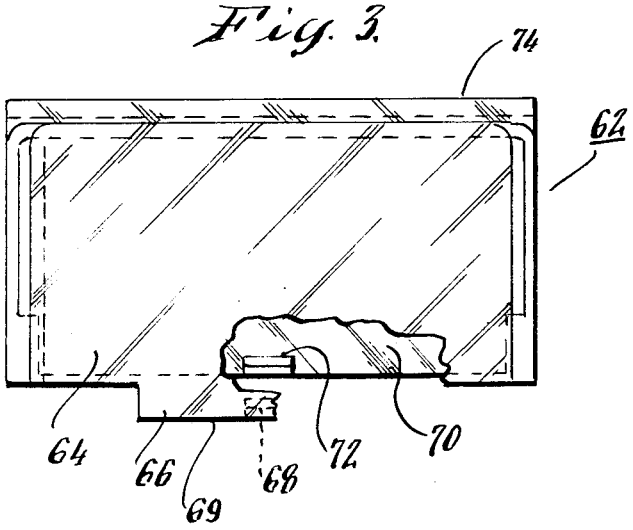
FIG. 3 is an enlarged, front elevation view, partly broken-away of the head guard of FIG. 1.
Figure 4:
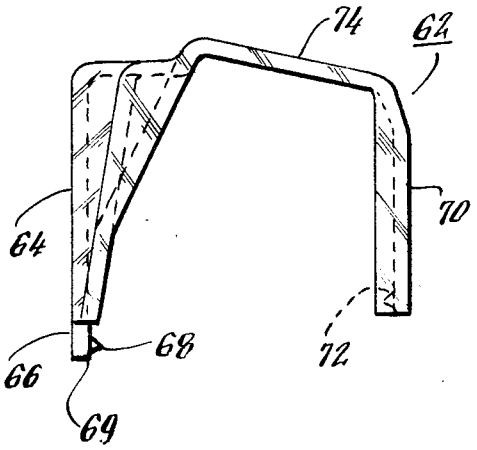
FIG. 4 is a side elevation view of the head guard of FIG. 3.
Figure 5:
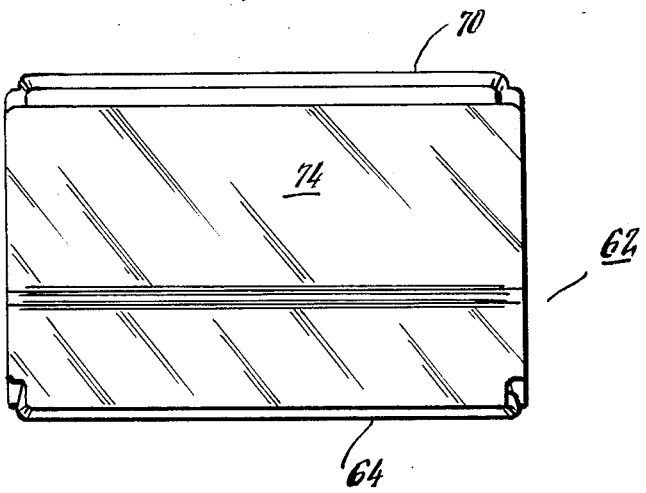
FIG. 5 is a top plan view of the head guard of FIG. 3.
Figure 6:
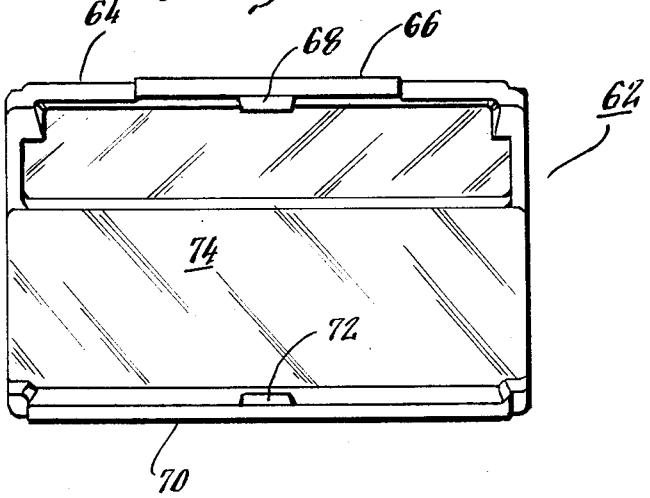
FIG. 6 is a bottom plan view of the head guard of FIG. 3.

A shaver On/Off slide switch 46 is mounted on the front side 48 of the housing. The slide switch 46 is formed to include an integrally formed, concave shaped finger recess 47. Slide 46 is positioned between guides 50 and 52 which are integrally formed with the housing. An upper edge 54 of switch 46 is positioned below the hair pocket by a small distance. A recess 56 is integrally formed in the housing at a location above the edge 54 of the switch. When the switch 46 is in its recessed position as illustrated in FIGS. 1 and 2, the recess 56 is visible. A user can actuate the switch 46 to an on or off condition by applying a manual force in a vertical upward or downward direction 45 as illustrated in FIG. 1. As illustrated in FIGS. 1 and 2, the switch 46 is retracted to its lowest vertical off position.

Actuation of the slide 46 from its off position causes internally positioned electric contacts 58 to couple a battery means, not shown, to an electric motor 60 which is mounted within the housing. The motor thus becomes energized and causes operation of the cutter head.

A head guard 62 is provided which is shaped to generally conform with the outer configuration of the shaver head 24 and the upper portion of the housing 22. It is preferably formed of a clear, transparent polymer plastic such as a polycarbonate. Integrally formed with the head guard 62 is a first elongated forward wall segment 64 having a depending apron 66 and a wedge shaped tab 26 extending inwardly from the apron segment 66. A second elongated rear wall segment 70 is integrally formed with the head guard 62 and includes a wedge-shaped tab 72. The head guard further includes an integrally formed cover segment 74.

The polymer plastic construction and the sizing of the head guard enable a slight deflection of the forward elongated segment 64 and the rearward elongated segment 70 so as to permit the extension of the head guard over and about the hair pocket 28. The head guard is sized to provide that when it is so positioned, the forward and rearward wall segments will deflect sufficiently to enable the tab 68 to extend into and engage the recess 56 and the tab 72 to extend about the skin stretcher slide segment 40. When so positioned and the tabs so engaged, the head guard is captivated by the engagement of these tabs to the hair pocket 28.

The head guard 62 is also sized for providing that the apron 66 can be positioned between switch guides 50 and 52 and a bottom edge 69 of the apron is juxtaposed with respect to the upper edge 54 of the slide switch 46. When the head guard is so positioned on the shaver, it inhibits upward movement of the slide switch 40 and thus avoids actuation thereof by any jarring motion of the switch 46 into an On position. However, an application of a manual force to the slide switch 46 causes the switch edge 54 to contact apron edge 69 and deflect the segment 64 sufficiently to release tab 68 from recess 56. The continued motion of switch slide 46 causes a rearward tilting of the guard 62 and a release of the head guard 62 from captivation by the shaver.

The arrangement thus described is advantageous in that in addition to the function of protecting the cutter head from abrasion and damage, the head guard 62 in cooperation with the shaver switch slide 46 inhibits inadvertant actuation of the shaver by jarring or the like and provides a means for ready release of the head guard upon the application of a manual force to the switch slide.

While there has been described a particular embodiment of the invention, it will become apparent to those skilled in the art that variations may be made thereto without departing from the spirit of the invention and the scope of the appended claims.

What is claimed is:

1. An improved head guard arrangement for a battery-operated electric dry shaver comprising:

a. A hand-held housing;

b. A shaver cutter head mounted at one end of said housing;

c. Electric motor means positioned within said housing;

d. Means including a battery and a shaver switch for applying operating potential from said battery to said motor;

e. A shaver switch actuating member positioned on said shaver;

f. Said actuating member having shaver operating and inoperative positioned;

g. A demountable head guard body positioned on said shaver and about said cutter head when said shaver is operative; and, h. Said head guard body including a segment thereof positioned adjacent said switch actuating member for inhibiting movement of said actuating member to an operating position when said head guard body is positioned on said shaver.

2. The shaver of claim 1 wherein the switch actuating member is mounted on the housing.

3. The shaver of claim 1 wherein said switch actuating member comprises a manually actuated slide body.

4. The shaver of claim 1 wherein said head guard segment includes an edge thereof, said slide includes an edge thereof and said edges are positioned in juxtaposed relationship.

5. The shaver of claim 4 including first and second parallel, spaced apart guide members, said slide is positioned between said guide members, and said head guard segment extends partly between said guides.

6. The shaver of claim 1 including captivating means positioned on said head guard and said shaver for maintaining engagement between said head guard and said shaver.

7. The shaver of claim 6 including tabs formed on said head guard and means positioned on said shaver for engaging said tabs.

8. The shaver of claim 7 including a recess formed in said housing for engaging a tab of said head guard.

9. The shaver of claim 8 wherein said recess is positioned adjacent to and in the path of movement of said actuating switch member whereby manual actuation of said member causes release of said tab from said recess.

10. An improved head guard arrangement for an electric dry shaver comprising:

a. A hand-held housing;
b. A shaver cutter head member positioned at one end of said housing;
c. Electric motor means positioned within said housing;
d. Means including a shaver switch actuating member for applying operating potential to said motor;
e. Said actuating member having shaver operating and inoperative positions;
f. A demountable head guard body positioned on said shaver and about said cutter head when said shaver is inoperative; and,
g. Captivating means positioned on said head guard and said shaver for maintaining engagement between said head guard and said shaver;
h. Said shaver switch actuating member positioned to contact and release said captivating means when said shaver switch actuating member is advanced from a shaver inoperative position to an operative position.

11. The improved shaver arrangement of claim 10 wherein said actuating switch member comprises a slide which is positioned on said shaver housing.

12. The improved shaver of claim 11 wherein said captivating means comprises first and second tabs formed on said head guard, means on said shaver for engaging said first and second tabs, said means for engaging said first tab positioned in the path of movement of said slide whereby advancing said slide from said shaver inoperative to said shaver operative positions engages said head guard and releases said first tab.

13. The improved shaver arrangement of claim 12 wherein said captivating means includes a recess formed in said shaver housing in the path of said actuating switch slide.

14. The improved shaver arrangement of claim 13 wherein said shaver housing includes first and second sides thereof, said recess is formed on a first side thereof and means are provided on said second side for engaging said second tab.

15. The improved shaver arrangement of claim 14 wherein said shaver includes a skin stretching means having an actuating member thereof, said skin stretching means is adapted to have a recessed inoperative position and an advanced operative position, and said second tab of said head guard engages said skin stretcher actuating segment.

16. The improved shaver arrangement of claim 15 wherein said head guard includes first and second elongated segments thereof which are deflectable for enabling positioning of said head guard about said shaver head and engagement of said captivating means.

17. The improved shaver arrangement of claim 16 wherein said housing includes first and second guide members, said first elongated segment includes an apron thereof which extends between said guides and has an edge thereof which is positioned juxtaposed with respect to said slide when said slide is positioned in a shaver operative position.

18. An improved head guard for an electric dry shaver, said head guard inhibiting movement of a shaver actuating member which member is manually operable between shaver operative and shaver inoperative positions, comprising a bonnet shaped body having integrally formed, elongated, generally parallel aligned front and rear surface segments thereof, said front segment having a lower part thereof and including an apron depending from said lower part, said apron positioned to engage and inhibit movement of the shaver actuating member when said bonnet is positioned on said shaver, a tab integrally formed with said apron, said rear surface segment including a second tab integrally formed with said second segment, a cover segment, said front and rear segments having a resiliency which enables deflection thereof for positioning said head guard on a shaver housing and deflection of said segments to enable a captivating seating of said tabs on said shaver.

19. The head guard of claim 18 wherein said head guard is formed of a polymer plastic.

20. The electric dry shaver head guard of claim 18 wherein said guard is adapted for use with a shaver of the type having a demountable hair pocket and said head guard is configured to extend substantially coextensively with outer surfaces of the hair pocket.

* * * * *